United States Patent [19]

Makimura et al.

[11] Patent Number: 4,833,012

[45] Date of Patent: May 23, 1989

[54] FIBER ENTANGLEMENTS AND METHOD OF PRODUCING SAME

[75] Inventors: Masaru Makimura; Kunio Kogame, both of Kurashiki, Japan

[73] Assignee: Kuraray Co., Ltd., Japan

[21] Appl. No.: 68,658

[22] Filed: Jul. 1, 1987

[30] Foreign Application Priority Data

Jul. 3, 1986 [JP] Japan ..... 61-157632

[51] Int. Cl.[4] ..... D04H 3/10; D04H 3/14; D06M 9/02; D06M 9/14

[52] U.S. Cl. ..... 428/288; 8/130.1; 26/18.5; 28/103; 28/107; 28/112; 28/168; 428/222; 428/290; 428/296; 428/300; 428/301; 428/370; 428/371; 428/409; 428/423.5; 428/423.7; 428/904; 428/909

[58] Field of Search ..... 8/130.1; 26/18.5; 28/103, 107, 112, 168; 428/288, 296, 300, 301, 909

[56] References Cited

U.S. PATENT DOCUMENTS 4,515,854 5/1985 Kogame et al. ..... 428/288
4,663,221 5/1987 Makimura et al. ..... 428/224

*Primary Examiner*—James C. Cannon
*Attorney, Agent, or Firm*—Kramer, Brufsky and Cifelli

[57] ABSTRACT

A fiber entanglement is provided which is characterized in that it is a three-dimensional entanglement comprising elastic fibers (A) each being a fine-denier fiber bundle or exhibiting porous fiber structure as seen on a fiber cross section with a number of irregularly-shaped pores extending in the fiber axis direction; nonshrinkable, nonelastic fibers (B); and shrinkable, nonelastic fibers (C); said fibers (A) are at least partially bonded or fused together at various points of contact with one another and, thereby, produce a taut condition; said nonshrinkable, nonelastic fibers (B) are folded several times over by means of the elastic fibers (A) and the shrinkable, nonelastic fibers (C). This fiber entanglement is useful as a base material for leather-like sheet materials.

33 Claims, No Drawings

FIBER ENTANGLEMENTS AND METHOD OF PRODUCING SAME

BACKGROUND OF THE INVENTION

1. Field of the Invention

This invention relates to fiber entanglements which resemble cowhide in stiff feeling and exhibit high-degree elongation until structural failure, high resistance to flexural fatigue and high dimensional stability; and, to nonwoven fabrics made therefrom useful as substrates for leather-like sheet materials.

2. Description of the Prior Art

Nonwoven fabrics composed of fiber entanglements have heretofore been used widely as leather-like sheet materials, substrates for leather-like sheet materials, interlining cloths, sanitary materials and sheet materials for industrial use. Furthermore, fiber entanglements are processed into and used as cords or strings. In recent years, several proposals have been made to produce nonwoven fiber entanglement fabrics having improved feeling. Thus, for instance, Japanese Patent Publication No. 18698/81 discloses a method of producing flexible nonwoven fabrics having a cantilever bending resistance of not more than 90 mm which comprises making a web by using a mixture, in a specific proportion, of two polyester fiber species differing in thermal shrinkability, followed by treatment for thermal shrinkage. Japanese Patent Publication No. 59-53388 discloses a method of producing flexible fibrous sheet materials having drapability which comprises making a web from highly shrinkable polyester fibers having latent spontaneous extensibility, subjecting the web to treatment for entanglement, then to treatment for shrinkage and heat-treating the same for spontaneous extension. According to the methods proposed in Japanese Laid Open Patent Publication Nos. 37353/81, 165054/81 and 42952/82, flexible fibrous sheet materials are produced by making a web from a blend of a highly heat-shrinkable fiber and a less heat-shrinkable. fiber, treating the web for entanglement, then for shrinkage and thereafter subjecting the web to heat treatment for spontaneous extension. Furthermore, Japanese Patent Publication No. 37208/85 discloses a method of producing nonwoven fabrics, which closely resemble woven fabrics in performance characteristics, which comprises exposing a web of a highly shrinkable synthetic fiber to a fine high-pressure jet stream of water for entanglement, wet heat treating the web for area shrinkage, drying the same at a temperature at which the form and internal structure of the constituent fibers will not change, and thereafter treating the same for thermal fixation under pressure. The present inventors also disclose fiber entanglement sheet materials made of elastic and nonelastic fibers which are stretchable and improved in feeling and drapability in Japanese Laid Open Patent Publication Nos. 211666/84 and 211664/84 (corresponding to U.S. Pat. No. 4,515,854 and EP No. 125,494).

The prior art fiber entanglement nonwoven fabrics have an increased apparent density of the entanglement as a result of additional shrinkage treatment. However, mere increase in fiber density brings about only a felt-like feeling, which is far from the desired flexible feeling with stiffness or fullness. It is for that reason that it has been proposed to improve the flexibility and drapability by simultaneously blending extensible fibers, performing shrinkage treatment and then carrying out spontaneous extension treatment. Improvements have indeed been made in this way from the feeling viewpoint but, heretofore, fiber entanglement sheet materials have not exhibited the feeling of cowhide which is free from boniness, being a tendency to form wrinkles like miniature ribs when folded, and high crease resistance as well as moderate resilience.

Furthermore, the fiber entanglement sheet materials proposed by the present inventors, which comprise elastic and nonelastic fibers are flexible, exhibit a wide range of stretchability without structural deformation and have good drapability.

SUMMARY OF THE INVENTION

This invention is directed to nonwoven entanglement fabrics which fall within the range of feeling which has never been attained by the prior art nonwoven entanglement fabrics which are made of a blend of shrinkable and nonshrinkable fibers, a blend of shrinkable and spontaneously stretchable fibers and non-shrinkable fibers or a blend of elastic and nonelastic fibers. Thus, it is an object of the present invention to provide fiber entanglements which exhibit stretchability without structural breakage within the elongation range of at least about 10 to about 30%, which are highly resistant to flexural fatigue as demonstrable by a number of very high-level repeated bendings until cracking occurs and which exhibit good dimensional stability. Such fiber entanglements have a boniness-free, stiff feeling with high crease resistance as well as moderate resilience.

The present invention thus provides a fiber entanglement produced by removing the nonelastic polymer from multicomponent fibers comprising elastic and nonelastic polymers and characterized in that it is a three-dimensional entanglement comprising elastic fibers (A); nonshrinkable, nonelastic fibers (B); and shrinkable, nonelastic fibers (C); said fibers (A) are at least partially bonded together at various points of contact with one another and thus produce a taut condition; and said nonshrinkable, nonelastic fibers (B) are folded several times over by means of said elastic fibers (A) and said shrinkable, nonelastic fibers (C).

The invention also provides a method of producing a fiber entanglement characterized in that it is a three-dimensional entanglement comprising elastic fibers (A); nonshrinkable, nonelastic fibers (B); and shrinkable, nonelastic fibers (C); said fibers (A) are at least partially bonded or fused together at various points of contact with one another and, thereby, produce a taut condition; said nonshrinkable, nonelastic fibers (B) are folded several times over by means of said elastic fibers (A) and said shrinkable, nonelastic fibers (C) and when said fiber entanglement has a thickness of about 1.0 mm, its elongation at structural failure is at least about 80% and its strength at structural failure is at least about 0.35 kg/mm2. The method comprises blending multi-component fibers (D) which are obtained by spinning elastic and nonelastic polymers followed by stretching with shrinkable, nonelastic fibers (C) or shrinkable, spontaneously stretching, nonelastic fibers (E) which exhibit a high shrinkage of at least about 20%, as measured in hot water at about 70° C., and which are obtained by spinning a nonelastic polymer followed by stretching with poorly shrinkable or nonshrinkable fibers (B) obtained by spinning a nonelastic polymer followed by stretching and exhibiting a shrinkage of not more than about 5%, as measured in hot water at about 70° C., in proportions such that the elastic fibers account for about 10 to about 70% by weight of the final fiber entanglement; synthesizing the fiber blend thus obtained into a web; subjecting the web to entanglement treatment; and, then, subjecting the fiber entanglement thus obtained to a combination of (a) the step of allowing the fiber entanglement to shrink under conditions such that the shrinkage of the multicomponent fibers (D) and/or the shrinkable, nonelastic fibers (C) or shrinkable, spontaneously stretching, nonelastic fibers (E) is greater than that of the nonshrinkable, nonelastic fiber (B); and if necessary, the step of allowing the shrinkable, nonelastic fibers to spontaneously stretch and (b) the step of releasing the elastic fibers (A) from the multicomponent fibers (D).

DETAILED DESCRIPTION OF PREFERRED EMBODIMENTS

The fiber entanglement according to the present invention has a construction such that the blending ratios among the elastic fibers (A), the nonshrinkable, nonelastic fibers (B), and the shrinkable, nonelastic fibers (C) in the final fiber entanglement are A/(B+C)= about 10/90 to about 70/30 and B/C= about 5/95 to about 80/20. As the amount of the elastic fibers (A) is increased, the stretchability and flexibility become increased, whereas an increase in the amount of the shrinkable, nonelastic fibers (C) results in an increased shrinkage of the entanglement and an increased fiber density therein, hence in an increased feeling of fullness. The elastic fibers (A) and the shrinkable, nonelastic fibers (C), through their synergistic effects, give a suppressed stretchability and a stiff feeling to the entanglement. In addition, the entanglement acquires a feeling of leather-like massiveness.

After entanglement formation, the elastic fibers (A) are released from the multicomponent fibers (D) obtained by spinning of elastic and nonelastic polymers, followed by stretching, by removing the nonelastic polymer from said multicomponent fibers (D). Thus, the elastic and nonelastic polymers are synthesized into fibers having a multicore core-sheath structure (or sea-island or oceano-insular structure) or an alternately joined divisional structure, with one polymer serving as a dispersion medium (or sea component) and the other occurring as a dispersed phase (or island component) as seen in the cross section, by spinning said polymers using the same melting system or using different melting systems but combining the polymer melts at the spinning head or spinneret level, for instance. The elastic polymer or elastomer which constitutes elastic fibers (A), comprises at least one polymer diol selected from among polyester diols, polyether diols, polyesterether diols, polylactone diols and polycarbonate diols, each having a mean molecular weight of about 500 to about 3,000; polyurethanes produced by reacting a polyisocyanate component whose main component is at least one organic polyisocyanate selected from among aromatic polyisocyanates, aliphatic polyisocyanates and the like with at least one compound selected from low-molecular compounds having two active hydrogen atoms and a molecular weight of not more than about 500, for example, diols, diamines and hydrazines; polyester elastomers produced by a condensation reaction between at least one polymer diol such as mentioned above and an aromatic dicarboxylic acid or an ester thereof, if necessary together with a low-molecular diol; polyamide elastomers produced by a condensation reaction of at least one polymer diol such as mentioned above with, for example, a polyamide having two terminal carboxyl groups and a mean molecular weight of not more than about 2,000, which polyamide serves as a hard segment; and synthetic rubbers. The fibers (A) comprise at least one of the polymers mentioned above. The nonelastic polymer to be spun with such elastic polymer in spinning the multicomponent fibers for the production of the elastic fibers (A) comprises at least one polymer selected from among highly flowable polyethylene, ethylene copolymers, polystyrene, styrene copolymers and the like, when it is used as a component to be removed later. For use as a fiber component in the alternately joined structure, the nonelastic polymer comprises at least one polymer selected from among polyesters, polyethylene, polypropylene, polyamides and the like. The multicomponent fibers thus spun are then drawn by the wet or dry method, or by a combination of the wet and dry methods, thermally set if necessary, further oiled, crimped and cut to give multicomponent staple fibers.

The nonshrinkable, nonelastic fibers (B) exhibiting a shrinkage of not more than about 5% as measured in hot water at about 70° C. are ordinary fibers or split or separated fibers and comprise at least one fiber species selected from among aromatic polyester fibers, polyamide fibers, polyolefin fibers, polyacrylic fibers, polyvinyl alcohol fibers and regenerated cellulose fibers, for instance. The preferred polymer species are polyethylene terephthalate, polybutylene terephthalate, nylon-6 and nylon-6.6, and the like.

The shrinkable, nonelastic fibers (C) or shrinkable, spontaneously stretching, nonelastic fibers (E) exhibiting a high shrinkage of at least about 20% as measured in hot water at about 70° C. comprise at least one fiber species selected from among polyethylene terephthalate fibers, copolymerized polyethylene terephthalate fibers with an ethylene terephthalate unit content of not less than about 80 mole percent, polybutylene terephthalate fibers, polyolefin fibers, polyvinyl alcohol fibers, polyvinyl chloride fibers and the like. Multicomponent fibers comprising at least two nonelastic, thermoplastic polymers can be used as well. When multicomponent fibers are used, it is preferable that the polymer used as the dispersion medium should soften at a temperature at which the dispersoid component shrinks and, hence, does not prevent the dispersoid component from shrinking. Preferred as fibers (C) are fibers having a low-crystallinity, low-orientation fiber structure, for example, fibers taken up at a rate of less than about 4,500 m/minute without drawing, and fibers exhibiting a crystallinity of less than about 20% and a shrinkage of at least about 20% as obtained by ordinary melt spinning, followed by taking up at a rate of less than about 1,500 m/minute with drawing at a low temperature at which no substantial increase in crystallinity is observable and without thermal setting. The use of these fibers is highly effective in providing the fiber entanglement with a feeling of fullness and stiffness by increasing the crystallinity of said fibers to a high level in a treatment step following the fiber entangling treatment.

The nonshrinkable, nonelastic fibers (B) and shrinkable, nonelastic fibers (C) or shrinkable, spontaneously stretching, nonelastic fibers (E) are oiled as necessary, crimped and cut to a staple fiber length of 20–150 mm. Thereafter, the fibers (D), fibers (B) and fibers (C) or (E) are blended in predetermined proportions, the mixture is made up into a random web or cross-lapped web on a card or into a web by the wet method from a dispersion of the fibers in a dispersion medium. A plurality of webs thus prepared are laid one upon another to give a web weight of about 100 to 2,000 g/m$^2$. Then, the fibers are entangled with one another by needle punching or by the high-pressure fluid jet method or by simultaneously using both techniques. The fiber entanglement thus obtained is now submitted to (a) the step of shrinking the fiber entanglement in hot water, steam or dry heat at a temperature of about 65° to about 98° C. under conditions such that the multicomponent fibers (D) and/or the shrinkable, nonelastic fibers (C) or shrinkable, spontaneously stretching, nonelastic fibers (E) can shrink to a greater extent than the nonshrinkable, nonelastic fibers (B) and (b) the step of releasing the elastic fibers (A) from the multicomponent fibers (D) and further, if necessary, releasing the shrinkable, nonelastic fibers (C) from the multicomponent fibers by treating with a solvent or decomposing agent for the nonelastic polymer component of the multicomponent fibers (D) or with a solvent or decomposing agent for the dispersion medium component of the multicomponent fibers (E) when the multicomponent fibers (D) and (E) have a multicore core-sheath (or sea-island) structure. When the fibers in question have an alternately joined sectional structure, the step (b) is carried out, for example, by treatment with a swelling agent for one component or with a surfactant solution to attain the division and separation. As a result, the fiber entanglement undergoes shrinkage to an area shrinkage of about 20 to about 70%, and the elastic fibers (A) released are freed from the elongated state resulting from drawing and shrinking accordingly while remaining at least partially bonded or agglutinated together at various points of contact with one another and thus forming an at least partially network-like structure, whereby the fibers (A) produce a taut condition. When spontaneously stretching fibers are used as the shrinkable, nonelastic fibers (C), the shrinkage treatment is followed by heat treatment for spontaneous stretching. As a result, the nonshrinkable, nonelastic fibers (B) are folded several times over within the fiber entanglement. Consequently, the fiber entanglement can show stretchability without structural break with an elongation of at least about 10% to about 30%, unlike ordinary fiber entanglement nonwoven fabrics which exhibit no stretching behavior but undergo structural break upon pulling or drawing. Said fiber entanglement, when it has a thickness of about 1.0 mm, exhibits an elongation at structural failure of at least about 80% and a strength at structural failure of at least about 0.35 kg/mm$^2$.

The fiber entanglement according to the invention is used as a substrate for leather-like sheet materials and, thus, it is provided with a polymer coat layer mainly consisting of an elastomer on its surface and further dyed, treated with a fire retardant and/or napped, for instance. Furthermore, the fiber entanglement may be immersed in a solution or dispersion of a polymer. The subsequent coagulation of the polymer favorably gives a feeling of fullness to the fiber entanglement.

The following examples are further illustrative of the preferred embodiments of the invention but are by no means meant as limitations of the invention. In the examples, unless otherwise specified, "part(s)" and "%" are on a weight basis.

EXAMPLES 1-3

Fifty (50) parts of a polyester polyurethane elastomer prepared by reacting polybutylene adipate glycol having a mean molecular weight of 1,000, diphenylmethanediisocyanate and butanediol and 50 parts of low-density polyethylene were melt-spun into two-component filaments having a sea-island structure with the polyethylene as the sea component as seen in cross section, the filaments were taken up at a rate of 1,000 m/minute, drawn 2.0-fold in warm water, oiled, crimped and cut to a length of 51 mm to give a staple fiber (hereinafter, fiber $D_1$) having a fineness of 4 dr and showing a shrinkage of 26% as measured in hot water at 70° C. Separately, polyethylene terephthalate was melt-spun and the filaments were taken up at a rate of 5,000 m/minute and, without drawing, oiled and crimped and then cut to a length of 51 mm to give a nonshrinkable staple fiber (hereinafter, fiber $B_1$) having a fineness of 2.5 dr and showing a shrinkage of about 3% as measured in hot water at 70° C. and a crystallinity of 37%. Furthermore, polyethylene terephthalate was melt-spun and the filaments were taken up at a rate of 3,500 m/minute and, without drawing, oiled, crimped and cut to a length of 51 mm to give a highly shrinkable staple fiber (hereinafter, fiber $E_1$) having a fineness of 2.5 dr and showing a shrinkage of 52% as measured in hot water at 70° C. and a crystallinity of 7.5%.

The fibers $D_1$, $B_1$ and $E_1$ were mixed in the proportions given in Table 1, opened on a card and made up into a web on a random webber. Three sheets of the web were placed one upon another and needlepunched alternately from both sides with #40 needles (in total 480 punches/cm$^2$) to give an entanglement nonwoven fabric having a weight of about 300 g/m$^2$ This entanglement nonwoven fabric was immersed in hot water at 70° C. for three minutes for shrinkage. After dehydration, the polyethylene in fibers Al was removed by dissolution in hot toluene. After drying, the entanglement nonwoven fabric was treated on a mirrorfinished metal drum having a surface temperature of 50° C. at a contact pressure of 0.5 kg/cm$^2$ for 30 seconds for smoothing the surface of the entanglement nonwoven fabric and improving the feeling of fullness thereof. The relative performance characteristics of the entanglement nonwoven fabrics thus obtained are shown in Table 1 and Table 2.

For comparison, the relative performance characteristics of entanglement nonwoven fabrics obtained by treatment under the same conditions as webs prepared from a mixture of fibers $B_1$ and $E_1$ without using the elastic fiber $D_1$ are also shown in Table 1 and Table 2.

TABLE 1

| | Fiber mixing ratio (%) | | | Performance characteristics of product entanglement nonwoven fabric | | | |
|---|---|---|---|---|---|---|---|
| No. | Fiber $D_1$ | Fiber $B_1$ | Fiber $E_1$ | Apparent density (g/cm$^2$) | *1 Flexibility | *1 Fullness | *1 Flexing resistance |
| Example 1 | 60 | 20 | 20 | 0.37 | ◎ | ◎ | ○ |
| Example 2 | 50 | 25 | 25 | 0.35 | ○ | ○ | ○ |
| Example 3 | 50 | 20 | 30 | 0.40 | ○ | ○ | ○ |
| Comparative | 0 | 50 | 50 | 0.28 | x | x | x |

TABLE 1-continued

| No. | Fiber mixing ratio (%) Fiber $D_1$ | Fiber $B_1$ | Fiber $E_1$ | Performance characteristics of product entanglement nonwoven fabric: Apparent density ($g/cm^2$) | *1 Flexibility | *1 Fullness | *1 Flexing resistance |
|---|---|---|---|---|---|---|---|
| Example 1 | | | | | | | |
| Comparative Example 2 | 0 | 40 | 60 | 0.31 | x Felt-like | Δ | x |

Notes:
*1 Results given by five panelists; best ◎ to x worst.
*2 Flexing test on a flexometer; results after 20,000 flexes; no cracking ○ to x marked cracking.

TABLE 2

| No. | Thickness (mm) | Strength at break ($kg/mm^2$) | Elongation at break (%) | Elastic recovery after 20% elongation (%) |
|---|---|---|---|---|
| Example 1 | 1.0 | 0.45 | 145 | 87 |
| Example 2 | 1.0 | 0.59 | 137 | 83 |
| Example 3 | 1.0 | 0.62 | 120 | 81 |
| Comparative Example 1 | 1.0 | 0.81 | 75 | 43 |
| Comparative Example 2 | 1.0 | 0.90 | 71 | 41 |

In the entanglement nonwoven fabrics thus produced according to the present invention, the polyurethane elastomer fibers were bonded together at many of the points of contact with one another, forming partial network structures. The entanglement nonwoven fabrics had the feeling of fullness, flexibility, stretchability and flexing resistance. They were napped on one side by buffing with sandpaper. The 1.5-mm thick sheets thus obtained were dyed to a brown color using a disperse dye and a carrier. The products obtained were suitable for use as a material sheet in manufacturing casual shoes with a velour tone.

EXAMPLE 4

Sixty (60) parts of a polyether polyurethane elastomer prepared by reacting polytetramethylene ether glycol, diphenylmethane-diisocyanate and bishydroxyethoxybenzene and 40 parts of polypropylene were melt-spun into two-component filaments of the alternately joined type as composed of five layers each of the polyurethane elastomer and polypropylene. The filaments were taken up at a rate of 1,500 m/minute, drawn 2.5-fold in warm water, oiled, crimped and cut to a length of 51 mm to give a staple fiber having a fineness of 3 dr (hereinafter, fiber $D_2$). When immersed in 0.1% aqueous solution of sodium oleate at 70° C., this fiber underwent splitting at the interface between the polyurethane elastomer layer and the polypropylene layer to give fine-denier fibers. As a result, the apparent length was reduced by 55%.

The fiber $D_2$ was mixed with the fibers $B_1$ and $E_1$ mentioned in Example 1 in the proportions of 40:20:40. The fiber blend was opened on a card and made up into a web on a random webber. Three sheets of the web were placed one on another and needle-punched alternately from both sides (in total 240 punches/m2) using #40 needles to given an entanglement nonwoven fabric having a weight of about 210 $g/m^2$. This entanglement nonwoven fabric was treated by applying jet streams of 0.2% aqueous solution of sodium oleate at 70° C. This resulted in splitting of the polyurethane fiber from the fiber $D_2$. Thus, fiber entangling and fiber shrinking were attained simultaneously. The entanglement obtained was further heat-treated at a drum surface temperature of 150° C. as in Example 1. The entanglement nonwoven fabric obtained had an apparent density of 0.41 $g.cm/^3$, and the polyurethane elastomer fibers were bonded together partly at points of contact with one another and the polypropylene fibers were fused together partly at points of contact. Thus, partial network structures were produced. Using the entanglement nonwoven fabric thus obtained as a base material, a leather-like sheet material was produced by providing it, on the smoothened surface thereof, with a surface coat layer by adhesion of a polyurethane elastomer coat film, followed by surface finishing.

This leather-like sheet material was flexible, stretchable and resistant to flexing and had a good feeling of fullness.

As described hereinabove, the entanglement nonwoven fabrics according to the invention fall within the range of boniness-free, mellow, stiff feeling which can never be reached by entangled fiber nonwoven fabrics made of nonelastic fibers alone. They exhibit stretchability without structural failure within the elongation range of about 10 to about 30%, have good resistance to flexural fatigue and are dimensionally stable.

Furthermore, the entanglement nonwoven fabrics according to the invention are useful as fibrous sheet materials without any further processing. They are also useful as base materials for the manufacture of leather-like sheet materials capable of meeting highlevel requirements relative to flexing resistance, flexibility and feeling of fullness.

What is claimed is:

1. Three-dimensional fiber entanglement comprising elastic fibers (A), nonshrinkable, nonelastic fibers (B) and shrinkable, nonelastic fibers (C); said fibers (A) being at least partially bonded or fused together at various points of contact with one another producing a taut condition; said nonshrinkable, nonelastic fibers (B) being folded several times over by means of said elastic fibers (A) and said shrinkable, nonelastic fibers (C); and when said fiber entanglement has a thickness of 1.0 mm, it exhibits an elongation at structural failure of at least about 80% and a strength at structural failure of at least about 0.35 $kg/mm^2$.

2. The fiber entanglement according to claim 1, wherein the blending ratios of the elastic fibers (A), nonshrinkable, nonelastic fibers (B) and shrinkable, nonelastic fibers (C) are $A/(B+C)=10/90$ to 70/30 and $B/C=5/95$ to 80/20.

3. The fiber entanglement according to claim 1 wherein the elastic fibers (A) comprise at least one elastomer selected from the group consisting of polyurethane elastomers, polyester elastomers and polyamide elastomers.

4. The fiber entanglement according to claim 2 wherein the elastic fibers (A) comprise at least one elastomer selected from the group consisting of polyurethane elastomers, polyester elastomers and polyamide elastomers.

5. The fiber entanglement according to claim 1 wherein the nonshrinkable, nonelastic fibers (B) comprise at least one member selected from the group consisting of polyester, polyamides, polyolefins, polyacrylnitrile and regenerated cellulose.

6. The fiber entanglement according to claim 2 wherein the nonshrinkable, nonelastic fibers (B) comprise at least one member selected from the group consisting of polyester, polyamides, polyolefins, polyacrylnitrile and regenerated cellulose.

7. The fiber entanglement according to claim 3 wherein the nonshrinkable, nonelastic fibers (B) comprise at least one member selected from the group consisting of polyester, polyamides, polyolefins, polyacrylnitrile and regenerated cellulose.

8. The fiber entanglement according to claim 1 wherein the shrinkable, nonelastic fibers (C) comprise polyethylene terephthalate or polybutylene terephthalate.

9. The fiber entanglement according to claim 2 wherein the shrinkable, nonelastic fibers (C) comprise polyethylene terephthalate or polybutylene terephthalate.

10. The fiber entanglement according to claim 3 wherein the shrinkable, nonelastic fibers (C) comprise polyethylene terephthalate or polybutylene terephthalate.

11. The fiber entanglement according to claim 5 wherein the shrinkable, nonelastic fibers (C) comprise polyethylene terephthalate or polybutylene terephthalate.

12. A method of producing a fiber entanglement which comprises:

(a) blending (i) multicomponent fibers (d) obtained by spinning elastic and nonelastic polymers followed by stretching, said multicomponent fibers convertible to elastic fibers (A);

(ii) shrinkable, nonelastic fibers (C) obtained by spinning a nonelastic polymer followed by stretching, which fibers exhibit a high shrinkage of at least about 20% as measured in hot water at about 70° C.; and (iii) poorly shrinkable or nonshrinkable fibers (B) obtained by spinning a nonelastic polymer followed by stretching, which fibers exhibit a shrinkage of not more than about 5% as measured in hot water at about 70° C.

in proportions such that elastic fibers (A) account for about 10 to about 70% by weight of the final fiber entanglement;

forming the fiber blend thus obtained into a web;

(c) subjecting the web to entanglement treatment; and (d) subjecting the fiber entanglement thus obtained to a combination of shrinking said fiber entanglement under conditions such that the shrinkage of the multicomponent fibers (D) and/or the shrinkable, nonelastic fibers (C) is greater than that of the nonshrinkable, nonelastic fibers (B) and converting the multicomponent fibers (D) into the elastic fibers (A), by treating with a solvent, swelling or decomposing agent for a component of multicomponent fiber (D).

13. The method according to claim 12, wherein the blending ratios of the elastic fibers (A), nonshrinkable, nonelastic fibers (B) and shrinkable, nonelastic fibers (C) are $A/(B+C)=10/90$ to 70/30 and $B/C=5/95$ to 80/20.

14. The method according to claim 12 wherein the elastic fibers (A) comprise at least one elastomer selected from the group consisting of polyurethane elastomer, polyester elastomers and polyamide elastomers.

15. The method according to claim 13 wherein the elastic fibers (A) comprise at least one elastomer selected from the group consisting of polyurethane elastomer, polyester elastomers and polyamide elastomers.

16. The method according to claim 12 wherein the nonshrinkable, nonelastic fibers comprise at least one member selected from the group consisting of polyesters, polyamides, polyolefins, polyacrylonitrile and regenerated cellulose.

17. The method according to claim 13 wherein the nonshrinkable, nonelastic fibers comprise at least one member selected from the group consisting of polyesters, polyamides, polyolefins, polyacrylonitrile and regenerated cellulose.

18. The method according to claim 14 wherein the nonshrinkable, nonelastic fibers comprise at least one member selected from the group consisting of polyesters, polyamides, polyolefins, polyacrylonitrile and regenerated cellulose.

19. The method according to claim 12 wherein the shrinkable, nonelastic fibers (C) comprise polyethylene terephthalate or polybutylene terephthalate.

20. The method according to claim 13 wherein the shrinkable, nonelastic fibers (C) comprise polyethylene terephthalate or polybutylene terephthalate.

21. A method of producing a fiber entanglement according to claim 12, wherein said elastic and nonelastic polymers are spun into multicomponent fibers (D) having a multicore core sheath structure, a sea island structure or an oceano-insular structure and said multicomponent fibers (D) are converted into said elastic polymers (A) by treating said multicomponent fibers (D) with a solvent or decomposing agent for said non-elastic polymer.

22. A method of producing a fiber entanglement according to claim 12, wherein said elastic and nonelastic polymers are spun into multicomponent fibers (D) having an alternately joined divisional structure and said multicomponent fibers (D) are converted into said elastic fibers (A) by treating said multicomponent fibers (D) with a swelling agent.

23. A method of producing a fiber entanglement which comprises:

(a) blending (i) multicomponent fibers (D) obtained by spinning elastic and nonelastic polymers followed by stretching, said multicomponent fibers convertible to elastic fibers (A);

(ii) shrinkable, spontaneously stretchable, nonelastic fibers obtained by spinning a nonelastic polymer followed by stretching, which fibers exhibit a high shrinkage of at least about 20% as measured in hot water at about 70° C., said shrinkable, spontaneously stretchable, non-elastic fibers convertible to shrinkable nonelastic fibers (C); and (iii) poorly shrinkable or nonshrinkable fibers (B) obtained by spinning a nonelastic polymer followed by stretching, which fibers exhibit a shrinkage of not more than about 5% as measured in hot water at about 70° C., in proportions such that elastic fibers (A) account for about 10 to about 70% by weight of the final fiber entanglement;

(b) forming the fiber blend thus obtained into a web;

(c) subjecting the web to entanglement treatment; and (d) subjecting the fiber entanglement thus obtained to a combination of shrinking said fiber entanglement under conditions such that the shrinkage of the multicomponent fibers (D) and/or the shrinkable, spontaneously stretchable, nonelastic fibers (C) is greater than that of the nonshrinkable nonelastic fibers (B); heating said fiber entanglement for spontaneously stretching; and converting the multicomponent fibers (D) to the elastic fibers (A), by treating with a solvent, swelling or decomposing agent for a component of multicomponent fiber (D).

24. A method of producing a fiber entanglement which comprises:

(a) blending (i) first multicomponent fibers (D) obtained by spinning elastic and nonelastic polymers followed by stretching, said multicomponent fibers (D) convertible to elastic fibers (A), (ii) second multicomponent fibers comprising at least two nonelastic thermoplastic polymers, wherein one of said polymers is a dispersion medium polymer and the other of said polymers is a dispersoid medium polymer, said second multicomponent fibers exhibiting a high shrinkage of at least 20% as measured in hot water at about 70° C. after spinning and wherein said second multicomponent fibers are convertible to shrinkable nonelastic fibers (C) by removing said dispersion medium polymer; and (iii) poorly shrinkable or nonshrinkable fibers (B) obtained by spinning a nonelastic polymer followed by stretching, which fibers exhibit a shrinkage of not more than about 5% as measured in water at about 70° C., in proportions such that the elastic fibers (A) account for about 10 to about 70% by weight of the final fiber entanglement;

(b) forming the fiber blend thus obtained into a web;

(c) subjecting the web to entanglement treatment; and (d) subjecting the fiber entanglement thus obtained to a combination of shrinking said fiber entanglement under conditions such that the shrinkage of said first multicomponent fibers (D) and/or said second multicomponent fibers is greater than that of the nonshrinkable nonelastic fibers (B); converting said second multicomponent fibers to shrinkable, nonelastic fibers (C) and converting said first multicomponent fibers (D) to said elastic fibers (A), by treating with a solvent, swelling or decomposing agent for a component of multicomponent fiber (D).

25. A method of producing a fiber entanglement according to claim 24 wherein said dispersion medium polymer softens at a temperature at which said dispersoid medium polymer shrinks.

26. The method according to claim 24, wherein the blending ratios of the elastic fibers (A), nonshrinkable, nonelastic fibers (B) and shrinkable, nonelastic fibers (C) are $A/(B+C)=10/90$ to $70/30$ and $B/C=5/95$ to $80/20$.

27. The method according to claim 24 wherein the elastic fibers (A) comprise at least one elastomer selected from the group consisting of polyurethane elastomers, polyester elastomers and polyamide elastomers.

28. The method according to claim 26 wherein the elastic fibers (A) comprise at least one elastomer selected from the group consisting of polyurethane elastomers, polyester elastomers and polyamide elastomers.

29. The method according to claim 24 wherein the nonshrinkable, nonelastic fibers (B) comprise at least one member selected from the group consisting of polyesters, polyamides, polyolefins, polyacrylonitrile and regenerated cellulose.

30. The method according to claim 26 wherein the nonshrinkable, nonelastic fibers (B) comprise at least one member selected from the group consisting of polyesters, polyamides, polyolefins, polyacrylonitrile and regenerated cellulose.

31. The method according to claim 27 wherein the nonshrinkable, nonelastic fibers (B) comprise at least one member selected from the group consisting of polyesters, polyamides, polyolefins, polyarcylonitrile and regenerated cellulose.

32. The method according to claim 24 wherein the second multicomponent fibers convertible to shrinkable nonelastic fibers (C) comprise polyethylene terephthalate or polybutylene terephthalate.

33. The method according to claim 26 wherein the second multicomponent fibers covertible to shrinkable nonelastic fibers (C) comprise polyethylene terephthalate or polybutylene terephthalate.

* * * * *